US006402106B1

(12) United States Patent
Padiak

(10) Patent No.: US 6,402,106 B1
(45) Date of Patent: Jun. 11, 2002

(54) MOUNTING BRACKET HAVING FLEXIBLE LOCKING ARM

(75) Inventor: Scott Padiak, Winnetka, IL (US)

(73) Assignee: Cormark, Inc., Elk Grove Village, IL (US)

( * ) Notice: Subject to any disclaimer, the term of this patent is extended or adjusted under 35 U.S.C. 154(b) by 0 days.

(21) Appl. No.: 09/812,666

(22) Filed: Mar. 20, 2001

(51) Int. Cl.[7] ..... A47B 96/00

(52) U.S. Cl. ..... 248/221.11; 211/90.01; 248/222.11; 248/225.2; 248/243

(58) Field of Search ..... 248/243, 244, 248/245, 219.1, 246, 250, 222.11, 222.51, 225.21; 211/87.01, 90.01; 108/108

(56) References Cited

U.S. PATENT DOCUMENTS 3,601,432 A * 8/1971 Fenwick ..... 248/243 X
4,048,768 A * 9/1977 Good ..... 52/36
4,133,433 A * 1/1979 Wolf ..... 211/192
4,154,419 A * 5/1979 Breidenbach ..... 248/243
4,171,789 A * 10/1979 Vander Hoek et al. ..... 248/243
4,222,542 A * 9/1980 Wilson et al. ..... 248/243
4,387,872 A * 6/1983 Hogue ..... 248/221.3
5,022,621 A * 6/1991 Quest ..... 248/225.2
5,538,213 A * 7/1996 Brown ..... 248/222.11
6,357,609 B1 * 3/2002 Van Noord et al. ..... 211/90.02

* cited by examiner

*Primary Examiner*—Leslie A. Braun
*Assistant Examiner*—Tan Le
(74) *Attorney, Agent, or Firm*—Welsh & Katz, Ltd.

(57) ABSTRACT

A molded bracket for mounting a sign to a post includes a locking arrangement to lock the bracket to the post. The bracket includes a main body portion having first and second retaining elements spaced from one another configured for engagement with the post by insertion into first and second post slots. The retaining elements engage an interior surface of the post at the slots. The main body portion is formed from a resilient material in an arcuate shape and extends away from the post intermediate the first and second retaining elements. A flexible locking arm extends from the main body intermediate the first and second retaining elements. The locking arm has a portion that extends non-linearly from the body and includes a head for insertion into a third slot in the post intermediate the first and second post slots and a latching element for engagement with the third slot. The latching element engages the post at the slot to maintain the bracket secured to the post. The bracket includes a coupling portion for mounting the sign to the bracket.

20 Claims, 1 Drawing Sheet

MOUNTING BRACKET HAVING FLEXIBLE LOCKING ARM

BACKGROUND OF THE INVENTION

The present invention pertains to a mounting bracket. More particularly, the present invention pertains to a mounting bracket having a flexible locking arm to enable secure attachment to a mounting base such as a rack vertical beam.

Sign display is a vitally important function for the retail industry. The principle function of a sign in a retail trade or store is to notify consumers of particular information about the product. While signs are quite effective in directing the consumers attention to a particular location, item or product, because the signs and the brackets from which the signs hang, can extend into an aisle way, they can be susceptible to damage from collisions with shopping carts, forklifts, or people. Thus, it is important that the sign mounting bracket maintains a secure connection to the base to ensure that the sign remains securely intact for viewing, while being sufficiently sturdy to withstand the weight of the attached sign or display and any inadvertent contact.

Typically mounting brackets are made out of relatively rigid heavyweight materials, such as metal. Although a rigid or metal bracket may provide an effective secure connection with the base and have a sturdy frame capable of withstanding the weight of a hanging display, the cost in manufacturing a metal bracket can be relatively expensive. Furthermore, a rigid bracket may not readily absorb the impact of a collision, and to this end, may become damaged, bent or broken upon such a collision.

In addition, one requirement of such mounting brackets is ready installation. Many brackets require fastening to the display using mechanical fasteners, such as nuts, bolts, screws and the like. While these fasteners provide acceptable attachment vis-a-vis strength and integrity, they can be quite labor intensive to install. Thus, brackets that use these fasteners may not be acceptable, particularly in those instances where many such signs are to be installed or mounted.

One conventional flexible bracket used in mounting systems has a two prong latching connection for attaching to the mounting system or display. One disadvantage of this type of brackets is that the two prongs are susceptible to bending and thus becoming disengaged in a small-scale collision. Further, because the brackets are flexible, the two-prong connection may not provide a secure locked connection with the mounting system.

Accordingly, there exists a need for a display bracket that is easy to manufacture and provides a secure lockable connection to a mounting base. Most desirably, the mounting bracket is flexibly designed and is properly reinforced to enable hanging a display or sign and to withstand inadvertent impact. Such a bracket is cost effective to manufacture and requires minimal or no external hardware for installation.

SUMMARY OF THE INVENTION

A bracket for mounting an associated sign to an associated post includes a post mounting portion and a coupling portion for mounting the sign to the bracket. A post to which the bracket is mounted post has at least three linearly arranged slots formed therein and defines wall portions between the slots and a lip at the slot. The post has an exterior surface and an interior surface.

The bracket is formed from a flexible, resilient material and includes a main body portion having first and second retaining elements spaced from one another. The retaining elements are configured for engagement with the post by insertion into first and second post slots. The retaining elements engage the interior surface of the post at the slots. Preferably, the retaining elements have a hook shape defining a shoulder that engages the interior surface of the post. The bracket includes a coupling portion for mounting the sign to the bracket.

The main body portion is arcuate and extends away from the post intermediate the first and second retaining elements. A flexible locking arm extends from the main body portion intermediate the first and second retaining elements. The locking arm has a portion that extends non-linearly from the main body portion. Preferably, the non-linear portion extends along the arcuate shape of the main body portion.

The locking arm includes a latching element for insertion into and engagement with a third post slot intermediate the first and second post slots. The latching element engages the post at the slot to maintain the bracket secured to the post.

In a present embodiment, the latching element includes a head portion insertable into the third post slot. The latching element includes a first detent for engaging the slot lip. Preferably, the latching element also includes a second detent for engaging the slot lip, with the first and second detents being adjacent one another.

The locking arm can include a flange extending transversely therefrom. The flange extends along a portion of the locking arm and terminates prior to a juncture of the locking arm and the bracket main body. The flange provides a finger or gripping region for bending (e.g., flexing) the arm to install or lock the bracket to the post.

The main body portion can include a curved flange extending along an outer portion of the arcuate shape. The flange has a length such that it extends beyond the first and second retaining members and is configured to rest against the post when the bracket is in place thereon.

The coupling portion can be formed on the bracket spaced from the main body portion. This provides a mounting for the sign that is spaced from the post to which the bracket is mounted. A beam can extend between the coupling portion and the main body portion. An angled truss can extend between the main body portion and the beam proximal the coupling portion to provide additional support for the sign and rigidity to the bracket.

These and other features and advantages of the present invention will be apparent from the following detailed description, the accompanying drawings and appended claims.

BRIEF DESCRIPTION OF THE FIGURES

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
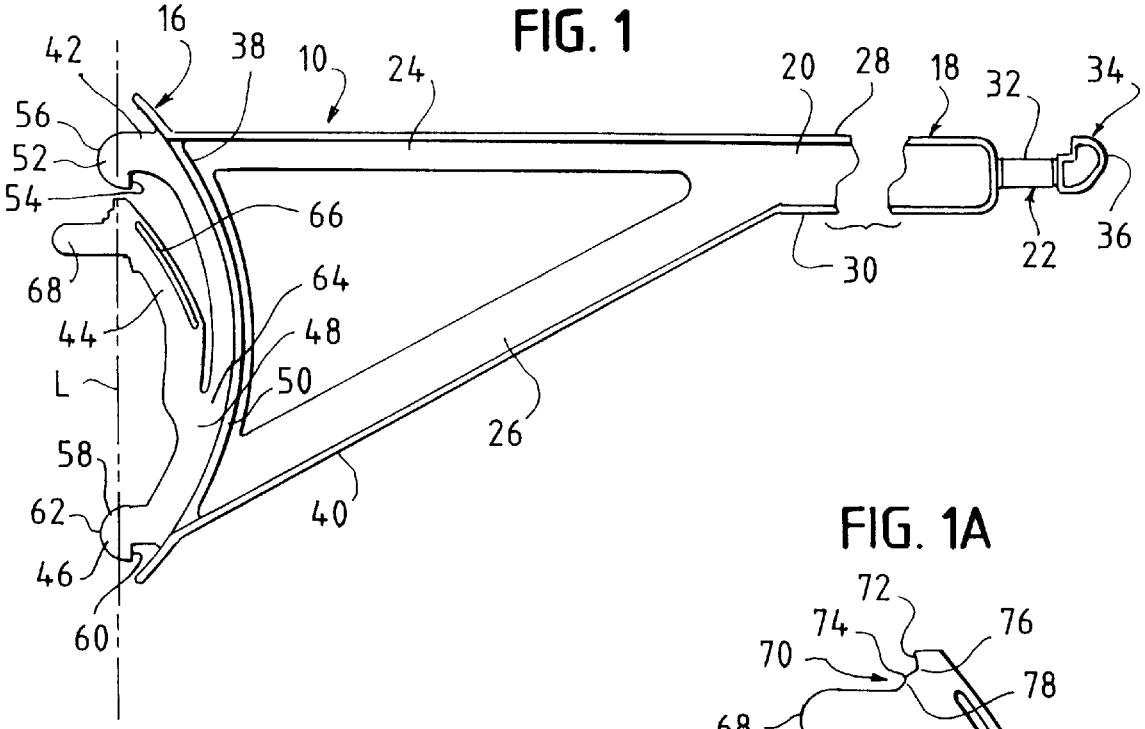
FIG. 1 is a side view of an embodiment of a mounting bracket embodying the principles of the present invention, the bracket being shown in a resting or non-flexed state, FIG. 1A being an enlarged view of the locking arm head and latching member.
Figure 1A:
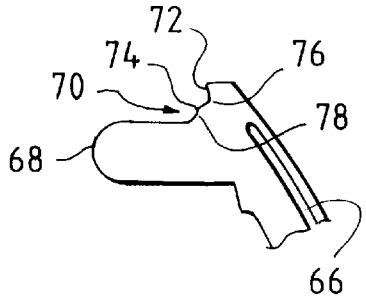

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated. It should be further understood that the title of this section of this specification, namely, "Detailed Description Of The Invention", relates to a requirement of the United States Patent Office, and does not imply, nor should be inferred to limit the subject matter disclosed herein.

Figure 2:
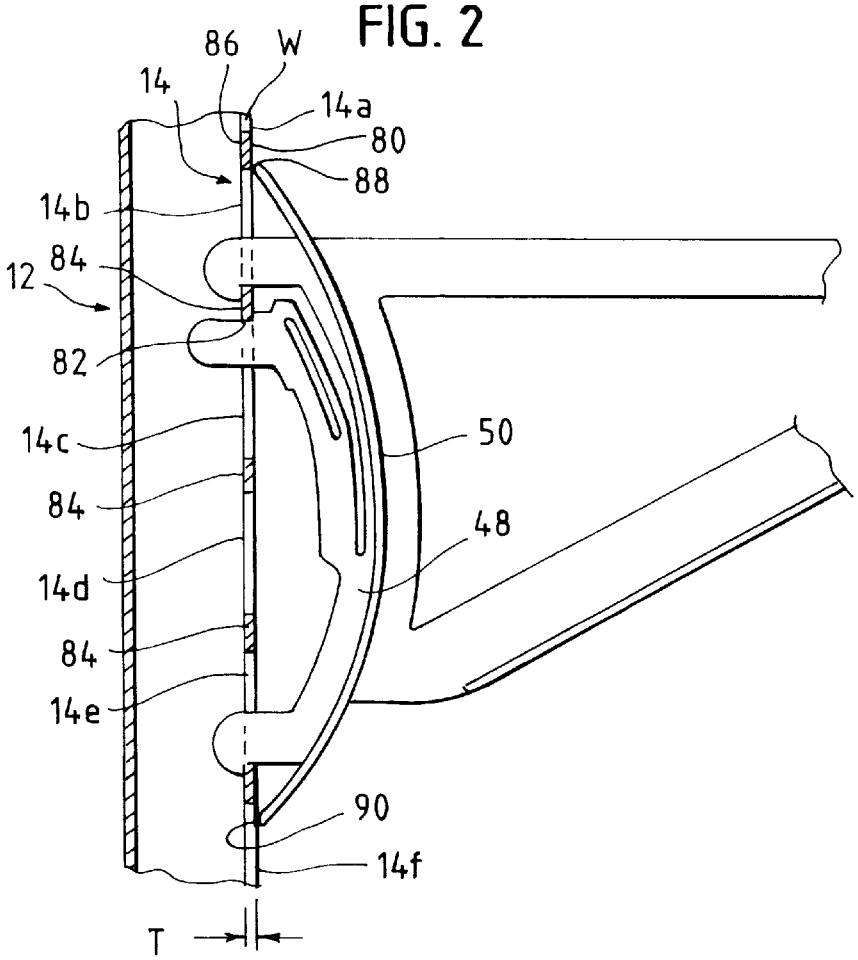
FIG. 2 is a side view of a portion of the mounting bracket of FIG. 1, as the bracket is installed on an upright for a display rack.

Referring now to the figures, and in particular FIG. 1, there is shown a mounting bracket 10 embodying the principles of the present invention. The mounting bracket 10 is mounted to a conventional mounting base 12, which is shown in FIG. 2. An exemplary base 12 is an upright 32 having a plurality of spaced channels or slotted openings 14*a–f*, enabling the bracket 10 to interlock with the base 12. In a typical application, the upright 12 will be one of a number of vertical posts to, for example, support a pallet rack. In an interlocked state, the mounting bracket 10 extends outwardly from the mounting base 12, as shown in FIG. 2, enabling an associated sign or display (not shown) to hang from the bracket 10.

The mounting bracket 10 is formed as an integral member and includes a first portion 16 for mounting to the base 12 that is contiguous with a second portion 18 from which a sign is mounted. The base mounting portion 16 includes an intermediate main support bar 20 extending between a coupling portion 22 and an adjoined beam 24 and truss 26 combination.

The mounting bracket 10 is formed from a molded plastic, polymeric or like resilient material, which enables flexible manipulation of the bracket 10 for connection to the mounting base 12. Notably, it is contemplated that the mounting bracket 10 can be formed from any resilient material without departing from the scope of the present invention.

The main support bar 20 has upper and lower edges or flange 28, 30, that extend along the bar 20 to provide stability to the bar against bending or flexing and to provide the bar 20 with additional structural reinforcement.

The coupling portion 22 is integrally connected to (e.g., formed as part of) an end of the bar 20. The coupling portion 22 includes a connecting arm 32 and a wedge-like element 34, configured for receipt in and connection to the sign or display (not shown). One exemplary arrangement for securing the coupling portion 22 to the sign is disclosed in Padiak et al., U.S. Pat. No. 5,933,932, which patent is commonly assigned herewith and is incorporated herein by reference.

The wedge 34 and connecting arm 32 are configured for receipt in an opening defined in the sign or display support or channel. As disclosed in the aforementioned patent to Padiak et al., the wedge 34 has a head 36 that cooperates with the sign support to prevent it from sliding or disengaging from the bracket 10.

The angled truss 26 and extending beam 24 combine in an adjoining manner for integral connection to the support bar 20. The beam 24 projects in a generally horizontal direction from the support bar 20, thus providing connection to the second or sign mount portion 18. The extended beam 24 engages the sign mount portion 18 in a generally upper region of a mounting portion 38.

The angled truss 26 extends from the support bar 20 to the sign mount portion 18. Preferably, the truss 26 engages a lower region of the mounting portion 38. The truss 26 has a supporting bottom edge or flange 40, which stabilizes the truss 26 against bending.

The mounting portion 38 provides a secure connection to the mounting base 12. Referring now to FIG. 2, the mounting portion 38 has a curved or arcuate configuration, and includes a first spine mount 42, a flexible locking arm 44 and a second spine mount 46. The first and second spine mounts 42, 46, in association with the locking arm 44 securely lock the bracket 10 to the base 12. The first and second spine mounts 42, 46 extend from a curved main support body 48.

The support body 48 has a curved flange 50 that enhances stability and structural integrity of the mounting portion 38. As illustrated in FIGS. 1 and 2, the curved flange 50 extends along a portion of the support body 48 at an outer region of the arc. The flange 50 facilitates securing the bracket 10 to the base 12. The flange 50 has a length somewhat longer than that of the mounting portion 38, and extends beyond the first and second spine mounts 42, 46.

The first spine mount 42 has a hook-like shape and includes a head portion 52 terminating at a shoulder or retaining element 54 at one end and extending to the other end into a rounded region 56. Similarly, the second spine mount 46 has a hook-like shape and includes a head portion 58 terminating at a shoulder or retaining element 60 and rounded region 62. Notably, the head portion rounded regions 56, 62 can take any shape to facilitate insertion into the mounting base slots 14.

The flexible locking arm 44 provides for secure locking engagement with the mounting base 12, to fasten the bracket 10 into position on the base 12. The locking arm 44 extends from a generally intermediate region (as indicated at 64) of the support body 48, extending arcuately along the body 48. In a current embodiment, the arm 44 extends in an upward direction, toward the first spine mount 42. A supporting flange 66 extends along a portion of the locking arm 44 to provide a finger hold for installation and removal.

The locking arm 44 has a rounded head 68 portion that extends outward from the locking arm 44, and is configured for insertion into an opening 14*c*, between the openings 14*b*, 14*e*, into which the first and second spine mounts 42, 46 insert into the base 12. An upper portion of head 68 terminates at a latching member 70. The latching member 70 has a plurality of graduated steps 72, 74 that define detents 76, 78. As illustrated in FIG. 2, upon insertion into a selected opening (such as 14*c*), one of the steps 72 or 74 engages an outer surface 80 of the base 12, while a corresponding detent 76 or 78 engages a lip portion 82 of the opening 14*c*.

Referring again to FIG. 2, the base 12 has the openings 14*a–f* formed therein, spaced apart from one another. As illustrated, each opening 14*a–f* is configured to receive a spine mount 42, 46 or the locking arm 44. Each opening 14*a–f* is separated from each adjacent opening by a portion, as indicated at 84, of the base wall W that defines the lip 82. The wall W also defines an interior surface 86 of the base 12 that is engaged by the spine mount shoulder 54, 60 when the bracket is in place.

The bracket 10 is locked into the base 12, by inserting the first and second spine mounts 42, 46 into openings 14*b*, 14*e*, respectively, and the locking arm 44 into opening 14*c*. As is readily apparent from FIG. 2, when the bracket is urged downwardly, the shoulders 54 and 60 are positioned against the interior surface 86. The locking arm head 68 inserts into opening 14*c* between those openings 14*b*, 14*e* into which the first and second spine mounts 42, 46 insert.

To provide a stabilizing lock, the locking arm 44 is flexed or compressed from a resting position (FIG. 1) into an engaging position FIG. 2). To compress the arm 44, the flange 66 is pulled back (toward the coupling member 22) until one of the detents 76 or 78 engages the opening 14*c* lip 82. The latching member 70 thus engages opening 14*c* with a comer of the lip 82 positioned in one of the detents 76 or 78. In this manner, the arm 44 is locked onto the base 12 in both the horizontal and vertical directions.

Because the arm 44 is pulled or flexed toward the body 48 to engage the latching member 70 with the opening 14*c*, the natural tendency of the arm 44 is move back to the resting position (FIG. 1). Thus, the arm 44 exerts a force against and into the base 12. This places a tension in the spine mounts 42, 46 thus enhancing the "locking" feature of the bracket 10 to the base 12. That is, the spine mounts 42, 46 are generally aligned with one another (as indicated at L in FIG. 1), and the arm head 68 is out of alignment with the mounts 42, 46. When the head 68 is inserted into opening 14*c* and the arm 44 is flexed rearward (toward body 48) to lock to the base 12, the head essentially aligns with the mounts 42, 46 (as seen in FIG. 2).

In addition, as seen in FIG. 2, the wall W portion 84 is captured between the first mount 42 and the latching portion 70. This provides a more secure engagement of the bracket 10 to the base 12. Moreover, when latching the latching member 70 to the base 12, it is necessary to flex the entirety of the body 48. Thus, the body ends 88, 90 provide an additional tension-like locking feature of the bracket 10 to the base 12.

A present embodiment of the bracket 10 is provided with two steps 72, 74. As will be appreciated by those skilled in the art, the base 12 can be formed (e.g., manufactured) having a variety of wall W thicknesses, as indicated at t, in FIG. 2. To this end, the number or steps 72, 74 formed in the bracket 10 can vary accordingly to permit use of the bracket 10 with a variety of upright 12 support designs and sizes.

To unfasten the mounting bracket 10 from the mounting base 12, the locking arm 44 is moved from the engaging position with opening 14*c* by urging or pulling the arm 44 (by the flange 66) rearwardly or back toward the body 48. This unlocks the detent 76 or 78 from the lip 82. The first and second mounts 42, 46 are then removed from the base 12 by unhooking or upwardly urging the bracket 10 to disengage the shoulders 54, 60 from the interior surface 86.

From the foregoing, it will be observed that numerous modifications and variations can be effectuated without departing from the true spirit and scope of the normal concepts of the present invention. It is to be understood that no limitation with respect to the specific embodiments illustrated is intended should be inferred. The disclosure is intended to cover by the appended clams all such modifications as fall within the scope of the invention.

What is claimed is:

1. A bracket for mounting an associated sign to an associated post having at least three linearly arranged slots formed therein, the post defining wall portions between the slots and having an exterior surface and an interior surface and further defining a lip at each slot, the bracket comprising:

a main body portion having first and second retaining elements spaced from one another configured for engagement with the post by insertion into first and second post slots, the retaining elements engaging the interior surface of the post at the slots, the main body portion being formed from a resilient material and extending away from the post intermediate the first and second retaining elements;

a flexible locking arm extending from the main body portion intermediate the first and second retaining elements, the locking arm having a portion that extends non-linearly from the main body portion, the locking arm including a latching element for insertion into and engagement with a third post slot intermediate the first and second post slots, the latching element engaging the post at the slot to maintain the bracket secured to the post; and a coupling portion for mounting the associated sign to the bracket.

2. The bracket in accordance with claim 1 wherein the first retaining element has a hook shape defining a shoulder for engaging the interior surface of the post.

3. The bracket in accordance with claim 1 wherein the second the retaining element has a hook shape defining a shoulder for engaging the interior surface of the post.

4. The bracket in accordance with claim 1 wherein the latching element includes a head portion insertable into the third post slot and a includes a first detent for engaging the slot lip.

5. The bracket in accordance with claim 4 wherein the latching element includes a second detent for engaging the slot lip, the first and second detents being adjacent one another.

6. The bracket in accordance with claim 1 wherein the locking arm includes a flange extending transversely therefrom, the flange extending along a portion of the locking arm and terminating prior to a juncture of the locking arm and the bracket main body.

7. The bracket in accordance with claim 1 wherein the main body portion has an arcuate shape.

8. The bracket in accordance with claim 7 wherein main body portion includes a curved flange extending along an outer portion of the arcuate shape, the flange having a length that such that it extends beyond the first and second retaining members, the flange configured to rest against the post when the bracket is in place thereon.

9. The bracket in accordance with claim 1 wherein the coupling portion is formed on the bracket spaced from the main body portion.

10. The bracket in accordance with claim 9 including a beam extending between the coupling portion and the main body portion.

11. The bracket in accordance with claim 10 including an angled truss extending between the main body portion and the beam proximal the coupling portion.

12. The display in accordance with claim 11 wherein the angled truss includes a lower flange.

13. A molded, unitary bracket for mounting an associated sign to an associated post, comprising:

a resilient body having first and second retaining elements spaced from one another and extending therefrom, the body having an arcuate shape with the retaining elements proximal ends thereof, the retaining elements configured for engagement with the post;

a flexible locking arm extending from the main body portion intermediate the first and second retaining elements, the locking arm having a portion that extends generally along the arcuate body shape and being flexible toward and away from the main body, the locking arm including an element extending therefrom for engagement with the post intermediate the first and second retaining elements.

14. The molded bracket in accordance with claim 13 including a coupling portion formed on the bracket spaced from the resilient body for mounting the associated sign to the bracket.

15. The molded bracket in accordance with claim 13 wherein the first and second retaining elements have a hook shape, each defining a shoulder.

16. The molded bracket in accordance with claim 13 wherein the locking arm element is a latching element and wherein the latching element includes a head portion for engagement with the post.

17. The molded bracket in accordance with claim 16 wherein the latching element includes a plurality of detents for engaging the post, the detents defined by steps adjacent one another.

18. The bracket in accordance with claim 13 wherein the locking arm includes a flange extending transversely therefrom, the flange extending along a portion of the locking arm and terminating prior to a juncture of the locking arm and the resilient body.

19. The molded bracket in accordance with claim 13 wherein the resilient body includes a curved flange extending along an outer portion of the arcuate shape, the flange having a length that such that it extends beyond the first and second retaining members.

20. A resilient, molded bracket for mounting an associated sign to an associated post, comprising:

first and second post retaining elements extending from a common body, the post retaining elements defining a line therebetween, the post retaining elements each having a shoulder thereon for engaging the post, the bracket including a flexible locking arm extending from the common body intermediate the first and second retaining elements, the locking arm extending generally along the arcuate body shape inwardly thereof, the locking arm being flexible toward and away from the common body, the locking arm including a latching element having a portion extending therefrom beyond the line defined by the first and second retaining elements, wherein when the first and second retaining elements are inserted into the post and the locking arm is flexed toward the body for inserting the latching element into the post intermediate the first and second latching elements, the latching element is flexed substantially into alignment with the first and second retaining elements and exerts a force on the post opposite to the retaining elements to secure the bracket to the post.

* * * * *